United States Patent [19]

Bender

[11] 4,099,309

[45] Jul. 11, 1978

[54] MANUFACTURE OF GRIDS

[75] Inventor: Ulrich Bender, Siegen, Germany

[73] Assignee: Firma Emil Bender, Siegen, Germany

[21] Appl. No.: 764,360

[22] Filed: Jan. 31, 1977

[30] Foreign Application Priority Data

Jan. 8, 1977 [DE] Fed. Rep. of Germany ..... 2700603

[51] Int. Cl.[2] ..... B21D 31/04

[52] U.S. Cl. ..... 29/2; 29/6.1; 429/242

[58] Field of Search ..... 429/242; 29/2, 6.1, 29/6.2; 83/695, 678

[56] References Cited

U.S. PATENT DOCUMENTS

| | | | |
|---|---|---|---|
| 1,052,888 | 2/1913 | Clark | 29/6.1 |
| 1,104,475 | 7/1914 | Clark | 29/6.1 X |
| 1,128,659 | 2/1915 | Clark | 29/6.1 X |
| 1,146,552 | 7/1915 | Clark | 29/6.1 |
| 1,664,247 | 3/1928 | Dean | 29/6.1 |
| 1,852,636 | 4/1932 | Arey | 29/6.1 |
| 1,985,893 | 1/1935 | Goodrich et al. | 29/2 |

*Primary Examiner*—Othell M. Simpson
*Assistant Examiner*—Horace M. Culver
*Attorney, Agent, or Firm*—Norman S. Blodgett; Gerry A. Blodgett

[57] ABSTRACT

Process for the manufacture of a grid comprising cutting a series of equal-length, parallel slits in a blank, each primary slit having a first neighboring slit on one side that is co-extensive with one-half of the primary slit and a second neighboring slit on the other side that is co-extensive with the other one-half of the primary slit, so that an area of double width appears beside each primary slit.

3 Claims, 3 Drawing Figures

MANUFACTURE OF GRIDS

BACKGROUND OF THE INVENTION

In the production of storage batteries or the like, wire meshes or grids are necessary for forming the positive and negative plates and the plate assemblies composed of them, it being possible for such grids to consist of materials of many different types, depending on the type of storage battery. Thus, for the manufacture of grids and the positive and negative plates which are formed thereby, other materials than lead or lead alloys have been used. Aluminum and copper, nickel, and iron, as well as nickel and cadmium alloys have, in fact, also been used for this purpose.

However, the manufacture of such wire meshes or grids is complicated and costly. Particularly when they consist of lead or lead alloys, they are in fact produced by an appropriate molding by a casting procedure, or they are even produced by a stamping operation from metal strips or the like. It can also be imagined that the grids could be produced from a plurality of intersecting profiled wires, the said wires being soldered or bonded to one another at their points of intersection. In the latter case, it is also necessary in addition for marginal strips without meshes to be connected at least to the top and the bottom edges of the grid, the said strips not only serving to hold and align the positive and/or negative plates in the casing of the battery, but also being capable of being used to connect the terminal heads.

A process for manufacturing grids to form positive and/or negatives plates for storage batteries or the like is also shown in the U.S. Pat. No. 3,853,626 in which the wire meshes or grids are formed from a metal strip which has two substantially parallel boundary edges, the said grids having a mesh-free strip at least at their top and bottom margins. In accordance with this process, the grids are manufactured in the same manner as expanded metal; that is to say, rows of cut slits are initially formed extending approximately parallel to the boundary edges of a metal strip, the ends of said slits having a fixed spacing from one another. The adjacent rows of such slits are so offset relative to one another in the longitudinal direction that the section of material which remains between those facing ends of two slits which lies on the same line is always disposed at half the length of the slits in the adjacent row. Thereafter, the bars of material which are left alongside the separately cut slits are deformed transversely of their longitudinal direction by a suitable tool, so that diamond-shaped mesh openings are formed between them. Using this type of process, therefore, the bars which define the individual meshes are stretched and, as a result, the crystalline structure thereof is modified. Using this procedure, it is the nodal points or junctions which are particularly stressed and from which in each case four mesh bars extend.

It is also disadvantageous in such case that the bars defining the individual meshes relatively to one another extend at an angle of inclination relative to the mesh-free strips which are provided on the upper and lower margins of the grid, so that the voltage potential set up in the positive and negative plate can never be discharged rectilinearly along the shortest path to the mesh-free marginal strip.

It is, therefore, an object of the invention to eliminate all disadvantages attached to the known grids for forming positive and negative plates for storage batteries or the like; it is, accordingly, a purpose of the invention to indicate a process for the manufacture of grids for forming positive and negative plates for storage batteries or the like from a metal strip or the like having two substantially parallel boundary edges and mesh-free strips limiting the grid (at least at the top and bottom margins thereof) wherein an expansion stress on the crosspieces or bars defining the meshes is avoided and, hence, a change in the crystalline structure of the material is avoided; the process makes it possible to provide grids in which one group of mesh bars extends parallel to the mesh-free strips on the margins and the other group of mesh bars extends at right angles to the said strips.

SUMMARY OF THE INVENTION

In general, the present invention consists in initially forming a metal strip or the like, starting at a distance from its boundary edges, with cut slits of predetermined length which are inclined to the said edges but are parallel to one another with a spacing corresponding to half the cut length formed between the ends of those cut slits which are disposed in a straight line. A slit in two different, adjoining longitudinal sections of the metal strip is positioned with its half length respectively between two slits disposed side by side on the same length section of the metal strip transversely of its boundary edges. Also, longitudinal sections adjoining these slits are provided which are offset transversely of the boundary edges of the metal strip with their ends facing one another. Finally, the boundary edges of the metal strip are simultaneously displaced parallel to and transversely of one another.

More specifically, in accordance with another technical feature of the process, it is proposed that the boundary edges of the metal strip are displaced so long or so far parallel to or transversely of one another that square meshes are formed which have one side approximately parallel, while on the other side bars are directed approximately at right angles to these boundary edges.

By the manufacture of the particular cut slit pattern in the metal strip and by the subsequent, specific displacement of its boundary edges relatively to one another, a grid is formed with which any stretching or expansion of material at the mesh bars is prevented. Only a restricted deformation by bending of the mesh bars occurs in the region of the junctions, this in fact being at a maximum in a bending angle of 90°. The size of the meshes is accordingly determined by the respective length of the slits and, in actual fact, the side length of a mesh is substantially equal to half the length of a slit.

A wire mesh or grid manufactured by the process previously described is characterized by the fact that the metal strips comprise a substantially diamond-shaped central region and two approximately rectangular marginal regions which adjoin the parallel sides of said central region, the slits being provided in the diamond-shaped middle region, while the marginal regions form the mesh-free marginal strips.

Furthermore, it is essential, according to the invention, that the mesh bars directed transversely of the mesh-free marginal strips have a cross-sectional height which is twice as large as the cross-sectional height of the mesh bars extending parallel to the mesh-free marginal strips.

Another essential feature of the invention consists of the fact that the nodal points or junctions between the meshes have a cross-sectional height which corresponds to three times the cross-sectional height of the narrow mesh bars or to one and a half times the cross-sectional height of the broad mesh bars.

Finally, it is also important, according to the invention, that all mesh bars extend obliquely from their junctions relative to the plane of the grid; hence, the broad mesh bars lie on common straight lines are connected to one another at the junctions so as to be offset from one another by half their cross-sectional height, while the narrow mesh bars on common straight lines are connected at the one end to the upper cross-sectional half of a broad mesh bar and at the other end to the lower cross-sectional half of the adjoining broad mesh bar.

Utilizing the procedures of the invention, the grids for the formation of positive and negative plates for storage batteries can not only be manufactured at low cost and with a saving of material, but it is also ensured that any damage to the crystalline structure of the material of the mesh bars is avoided and that the discharge of the voltage potential established in the positive or negative plates of the storage batteries can take place to the terminal heads via the shortest route and by way of optimal mesh bar cross-sections.

The U.S. Pat. No. 1,608,476 has already described the manufacture of ribbed expanded metal panels having square meshes from a metal strip which has been provided in advance with groups of slits extending obliquely in relation to its parallel boundary edges. However, in that arrangement, the slits are so arranged in series that they always overlap in a manner similar to scales over their half length. Accordingly, rectilinearly extending, unsplit strips of material are always left between two adjacent rows of slits; the said strips form ribs extending parallel to the boundary edges of the panel.

It should also be mentioned that the construction of a ribbed expanded metal panel illustrated in the U.S. Pat. No. 1,608,476 cannot in practice be manufactured at all; this is because it comprises two groups each consisting of three meshes of different size, which meshes, in the formation thereof make necessary displacement movements of the different strip regions relative to one another which are of different value. The further processing of the metal strip provided with the slits to form ribbed expanded metal panels is consequently, if at all, only to be achieved by various operating procedures and by the use of different sets of tools. The production of the ribbed expanded metal panels according to U.S. Pat. No. 1,608,476 is consequently at least just as costly and disadvantageous as the formation of wire meshes or grids in accordance with U.S. Pat. No. 3,853,626. With regard to U.S. Pat. No. 1,608,476, the mesh bars which extend at right angles to the panel margins have a smaller cross-sectional dimension than the ribs directed parallel to the said panel margins.

DESCRIPTION OF THE PREFERRED EMBODIMENT

Figure 1:
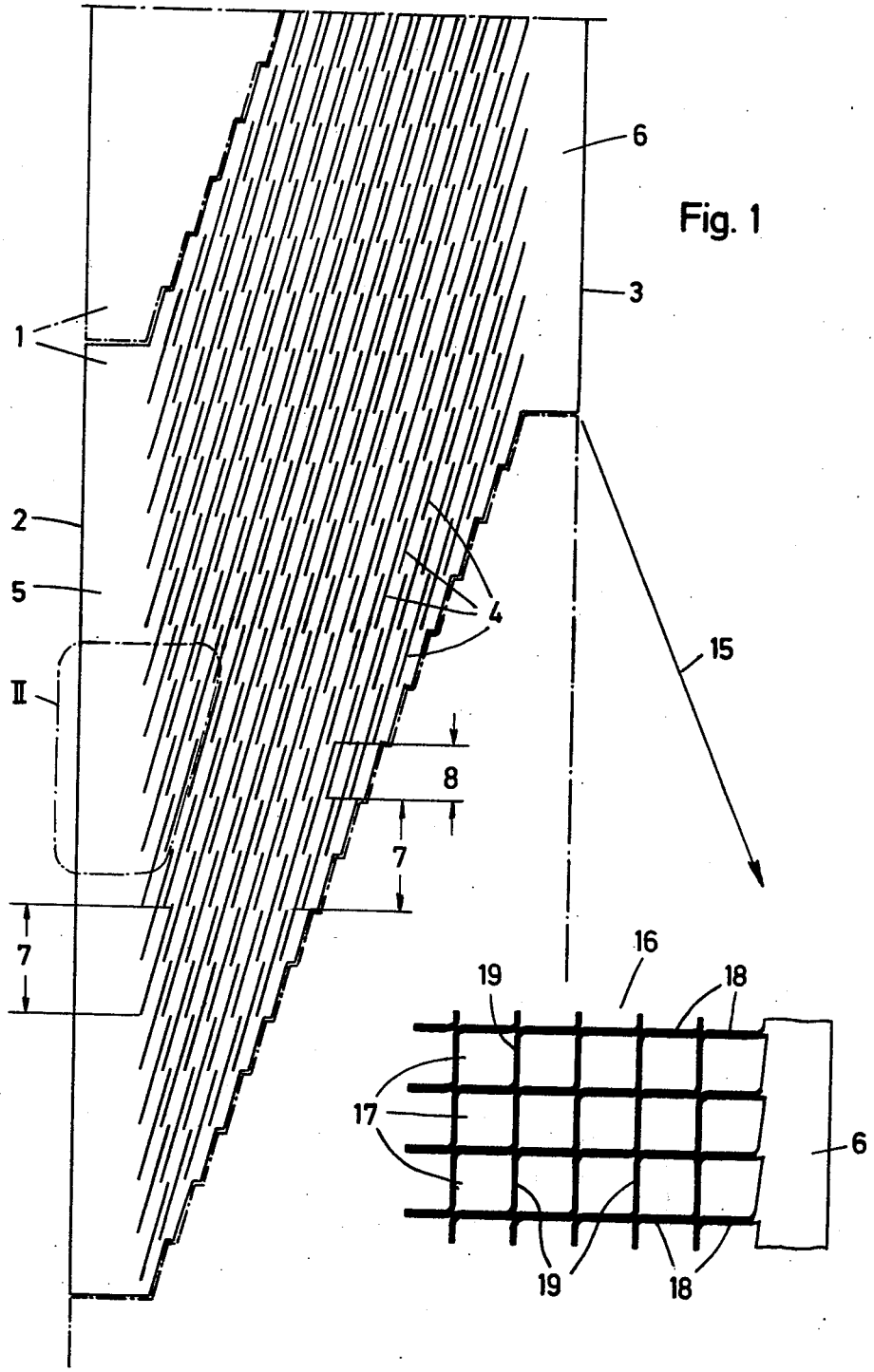
FIG. 1 is a plan view of a section of metal strip, which is provided in a region of prescribed shape and size with a uniform pattern of slits, a detail of the grid which can be produced therefrom also being indicated.
Figure 2:
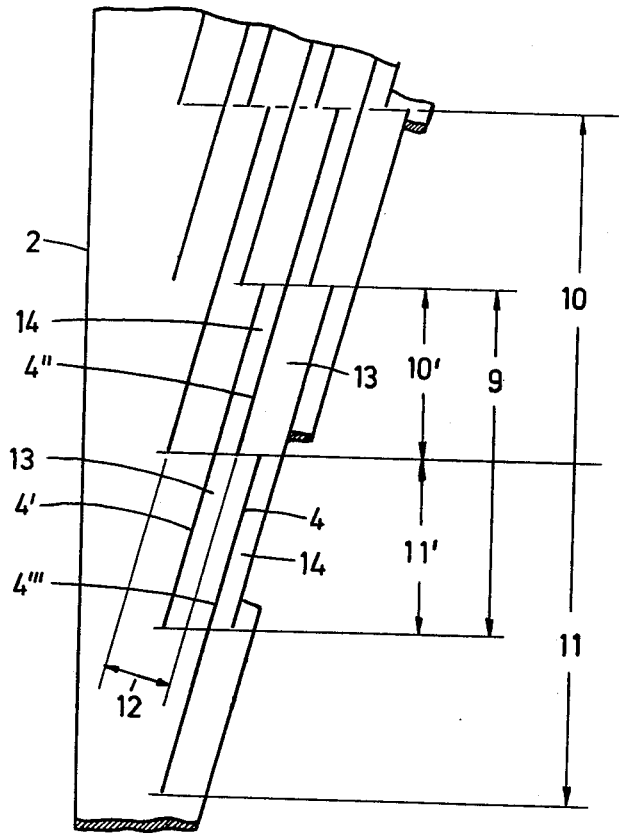
FIG. 2 is an enlarged view of a portion of the strip as indicated at II in FIG. 1.

FIG. 1 illustrates a section 1 of strip material, which may consist of any metal which is suitable for the manufacture of positive and negative plates of storage batteries, such as lead or lead alloys. This strip material has two longitudinal edges 2 and 3 which are parallel to one another and is formed on an approximately diamond-shaped surface region with a pattern of cut slits 4 which are in a very specific design. The slits 4 are so arranged that an unslitted strip 5 remains adjoining the longitudinal edge 2 and an unslitted strip 6 remains beside the longitudinal edge 3.

All slits 4 are inclined at an acute angle to the longitudinal edges 2 and 3 and also have a pre-established length 7. Provided between the ends of the respective slits 4 (which are in a straight line) is a gap 8 which corresponds to half the length of a slit 7. Provided between two cut slits 4′ (which are disposed side by side on the same longitudinal section 9 of the metal strip 1 and transversely of its longitudinal edges 2 and 3) is a slit 4″ from the adjoining length region 10 and a slit 4‴ from the adjoining length region 11, having a half length 10′ and 11′, respectively. The arrangement of the slits 4″ and 4‴ between two slits 4′ is developed in such a way that these are disposed in an offset manner relative to one another at the ends facing one another and in a direction transversely of the longitudinal edges 2 and 3 of the metal strip 1. The offset position of the slits 4″ and 4‴ between two adjacent slits 4′ is chosen so that the spacing 12 separating the slits 4′ is reduced to a third. A strip 13 of material still remains between a slit 4′ on the left and the slit 4‴ arranged in juxtaposition in its lower half, the width of the said strip corresponding to two thirds of the separation spacing 12, while a strip of material 14 still remains between the slit 4‴ and the slit 4′ disposed on the right thereof, said strip being equal to a third of the spacing 12. Conversely, in the region of the upper half of the slit 4′, i.e. between the left slit 4′ and the slit 4″ disposed alongside the latter, a strip of material 14 still remains, the width of which corresponds to a third of the spacing 12, while the strip of material 13 between the slit 4″ and the slit 4′ disposed on the right thereof has a width which is equal to two thirds of the spacing 12.

After the diamond-shaped region of the metal strip is provided with the pattern formation 4 of the slits, it is only necessary, for example, for the edge strip 6 to be displaced in the direction of the arrow 15 relative to the strip 5, as is indicated in FIG. 1. Solely as a result of this relative displacement between the edge or marginal strips 5 and 6 and resulting from a longitudinal movement and a transverse movement, a mesh or grid 16 can then be formed from the metal strip section which has the slit pattern 4. The shape of the meshes 17 in this mesh or grid 16 is in this case dependent on the amount of the relative displacement between the two marginal strips 5 and 6. The amount of the relative displacement is so chosen that approximately square mesh openings are produced, such as those indicated bottom right in FIG. 1. In this arrangement, each separate mesh 17 of the grid 16 is defined by two transverse crosspieces 18 and two longitudinal crosspieces 19. The transverse crosspieces or bars 18 extend at right angles to the solid marginal strips 5 and 6, while the longitudinal crosspieces or bars 19 extend parallel thereto.

Figure 3:
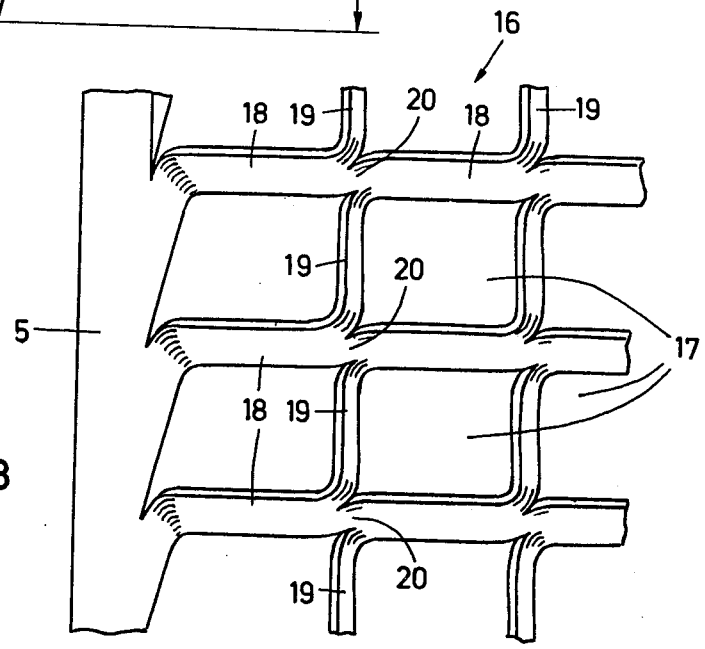
FIG. 3 is a perspective representation of the strip of FIG. 2 shaped to form a grid.

It is clearly apparent in FIG. 3 that each transverse bar 18 is formed from a broad material strip 13 and each longitudinal bar 19 is formed from a relatively narrow material strip 14. However, this means that the transverse bars 18 have a cross-sectional height which is twice as large as the cross-sectional height of the longitudinal bars 19.

On the other hand, it is also apparent from FIG. 3 that, in the region of each junction 20 between four meshes adjoining one another, there is a cross-sectional height which corresponds to three times the cross-sectional height of the longitudinal bars 19 or to one and one-half times the cross-sectional height of the transverse bars 18.

On account of the particular relative position between the slits 4', 4" and 4"', it is also apparent that all bars 18 and 19 of the meshes are inclined from the junctions 20 relative the plane of the grid. The broad transverse bars 18 lying on common straight lines are interconnected in a manner offset from one another by half their cross-sectional height at the junctions 20, while the longitudinal bars 19 lying on common straight lines are connected at the one end to the upper cross-sectional half of one transverse bar 18 with the other end to the lower cross-sectional half of the adjoining transverse bar 18.

With the use of the grids 16 as positive or negative plates for storage batteries or the like, the particular advantage of the development of the mesh bars 18 and 19, as described, consists in the fact that the mesh bars 18 which have the largest cross-section extending at right angles to the solid marginal strips 5 and 6 of the voltage potential established in the plates.

It is important that no tensile stress occur on the mesh bars 18 and 19 at the time that the metal strip sections provided with the slits 4 are deformed to form grids or meshes 16, but that only slight bending deformations are produced in the region of the nodal points or junctions 20. In conclusion, it should be mentioned that those facing ends of two adjacent slits 4 which are transversely disposed offset from one another do not have to end exactly on a common transverse plane. It is also possible for the ends of these slits 4 to overlap somewhat relative to the given transverse plane. It is possible by means of this procedure, in certain circumstances, for the bending behavior of the material to be improved at the time of deforming the metal strip section into the grid 16. This is particularly important when the strip material is to be deformed to form a grid has a relatively high resistance to bending.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Process for the manufacture of a grid, comprising:
   (a) providing a metal strip of generally diamond shape having opposite edges which are spaced and parallel,
   (b) forming a pattern of equal-length, parallel primary slits that extend entirely through the strip, the pattern being also of generally diamond shape, but smaller than the outline of the strip to leave slit-free elongated areas along the said opposite edges, each primary slit having a first neighboring slit on one side that is co-extensive with one-half of the primary slit and a second neighboring slit on the other side that is co-extensive with the other one-half of the primary slit, so that an area of double width appears beside each primary slit, and
   (c) deforming the strip by parallel and transverse movement of the slit-free areas in the plane of the strip, thus forming a grid with single-width bars extending transversely of the said area.

2. Process according to claim 1, characterized by the fact that junctions (20) are provided between the meshes (17), which junctions have a cross-sectional height which corresponds to three times the cross-sectional height of the single-width bars (19) and one-and-one-half times the cross-sectional height of the double-width bars (18).

3. Process according to claim 1, characterized by the fact that the said bars (18 and 19) extend from the junctions (20) at an angle to the general plane of the grid.

* * * * *